US005622431A

United States Patent [19]

Simonsen

[11] Patent Number: 5,622,431

[45] Date of Patent: Apr. 22, 1997

[54] EXTERNAL ZIPPER CLIP FOR A BAG

[75] Inventor: Steven H. Simonsen, Neenah, Wis.

[73] Assignee: Reynolds Consumer Products Inc., Appleton, Wis.

[21] Appl. No.: 494,454

[22] Filed: Jun. 26, 1995

[51] Int. Cl.[6] ..... B65D 33/16

[52] U.S. Cl. ..... 383/63; 383/68; 24/576

[58] Field of Search ..... 383/13, 15, 34, 383/34.1, 43, 68, 69; 24/30.5 R, 587, 576

[56] References Cited

U.S. PATENT DOCUMENTS

| | | | |
|---|---|---|---|
| 2,363,926 | 11/1944 | Arens . | |
| 3,026,017 | 3/1962 | Hopkins . | |
| 4,634,006 | 1/1987 | Yanase . | |
| 4,656,697 | 4/1987 | Naslund . | |
| 4,661,990 | 4/1987 | Rifkin . | |
| 4,703,518 | 10/1987 | Ausnit | 383/68 X |
| 4,787,755 | 11/1988 | Branson | 383/68 X |
| 4,796,300 | 1/1989 | Branson | 383/68 X |
| 4,871,264 | 10/1989 | Robbins, III et al. | 383/68 |
| 4,926,526 | 5/1990 | Brown et al. . | |
| 5,048,692 | 9/1991 | Handler et al. . | |
| 5,167,608 | 12/1992 | Steffens, Jr. et al. . | |
| 5,211,482 | 5/1993 | Tilman . | |

FOREIGN PATENT DOCUMENTS

| | | | |
|---|---|---|---|
| 9216424 | 10/1992 | WIPO | 383/68 |

OTHER PUBLICATIONS

AGLESS Oxygen Absorber brochure, p. 23, Mitsubishi Gas Chemical Company, Inc., date unknown.

*Primary Examiner*—Jes F. Pascua
*Attorney, Agent, or Firm*—Alan T. McDonald

[57] ABSTRACT

A reclosable bag arrangement comprises a bag and an external zipper clip. The bag includes first and second opposing films. The external zipper clip includes first and second opposing closure profiles adapted to releasably engage each other. Each of the first and second closure profiles has opposing ends, and the opposing ends of the first closure profile are attached to the respective opposing ends of the second closure profile. The first and second opposing films extend through the zipper clip between the first and second closure profiles. The zipper clip closes the bag in response to interlocking the first and second closure profiles with the first and second films interposed therebetween. The zipper clip is not heat-sealed or adhered to the bag such that the zipper clip is separable from the bag in response to disengaging the first and second closure profiles. Since the zipper clip may be separated from the bag, the material of the zipper clip need not be heat-sealable to the bag and the zipper clip may be reused with other bags.

12 Claims, 2 Drawing Sheets

EXTERNAL ZIPPER CLIP FOR A BAG

FIELD OF THE INVENTION

The present invention generally relates to a method of reclosing bags and, more particularly, relates to a bag provided with an external zipper clip for opening and reclosing a variety of bags.

BACKGROUND OF THE INVENTION

A reclosable bag is generally provided with a zipper at the mouth end thereof for opening and reclosing the bag. The zipper includes opposing male and female closure profiles configured to releasably interlock with each other. Heretofore, the zipper has been adhered to the mouth end of the bag using a variety of techniques. In one technique, a base of the male closure profile is adhered to an inner surface of a front film of the bag, while a base of the female closure profile is adhered to an inner surface of a back film of the bag. This adherence is typically achieved by means of heat fusion. In another technique, the male and female closure profiles are integrally formed with the inner surfaces of the respective front and back films of the bag by means of coextrusion.

U.S. Pat. No. 4,787,755 to Branson teaches yet another technique in which the zipper is affixed by heat sealing equipment to the exterior of the bag. More specifically, a male closure profile is sealed at least on its ends to the outer surface of one film of the bag, while a female closure profile is sealed at least on its ends to the outer surface of the opposing film of the bag. The male and female closure profiles are adapted for interlocking with the front and back films of the bag interposed therebetween.

A drawback of the reclosable bag disclosed in the Branson patent is that the polymeric material of the closure profiles must be heat-sealable to the polymeric material of the bag films in order to adhere the closure profiles to the respective bag films. This required compatibility of materials limits the combinations of materials which may be utilized with each other. Another drawback of the reclosable bag disclosed in the Branson patent is that the zipper can only be employed with the bag to which it is affixed. The zipper cannot be reused with another bag. When an individual wishes to dispose of the bag, he or she must necessarily dispose of the attached zipper. Such obligatory disposal of the attached zipper is wasteful.

A need therefore exists for a reclosable bag arrangement which overcomes the aforementioned shortcomings associated with the reclosable bag disclosed in the Branson patent.

SUMMARY OF THE INVENTION

In one particular embodiment, the present invention provides a reclosable bag arrangement comprising a bag and an external zipper clip. The bag includes first and second opposing films. The external zipper clip includes first and second opposing closure profiles adapted to releasably engage each other. Each of the first and second closure profiles has opposing ends, and the opposing ends of the first closure profile are attached to the respective opposing ends of the second closure profile. The first and second opposing films extend through the zipper clip between the first and second closure profiles. The zipper clip closes the bag in response to interlocking the first and second closure profiles with the first and second films interposed therebetween. The zipper clip is not heat-sealed or adhered to the bag such that the zipper clip is separable from the bag in response to disengaging the first and second closure profiles. Since the zipper clip may be separated from the bag, the material of the zipper clip need not be heat-sealable to the bag and the zipper clip may be reused with other bags.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
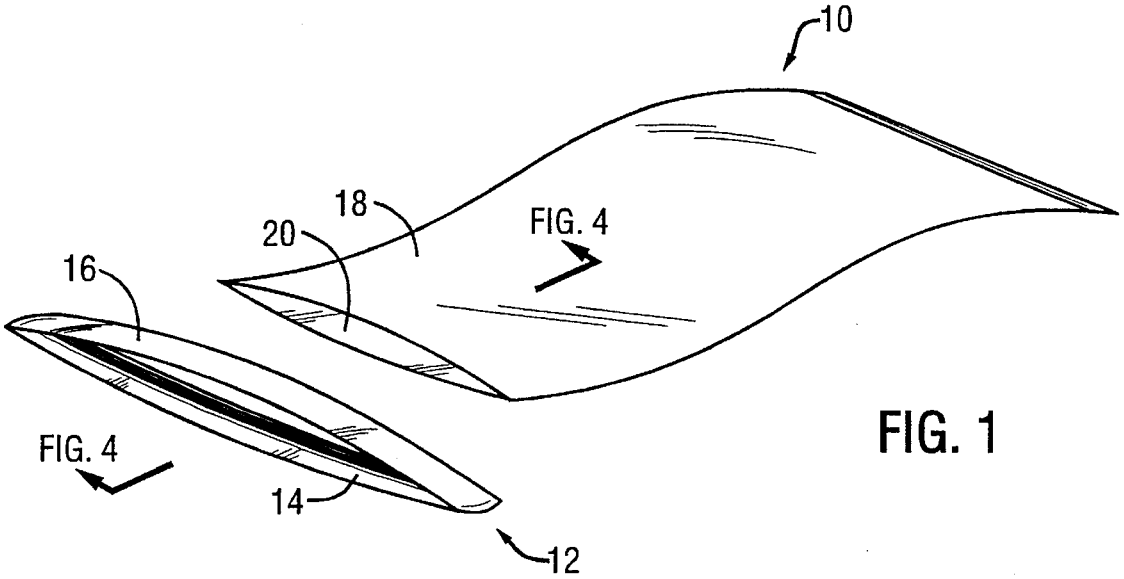
FIG. 1 is a perspective view of a reclosable bag arrangement embodying the present invention, showing a zipper clip separated from the bag.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Figure 2:
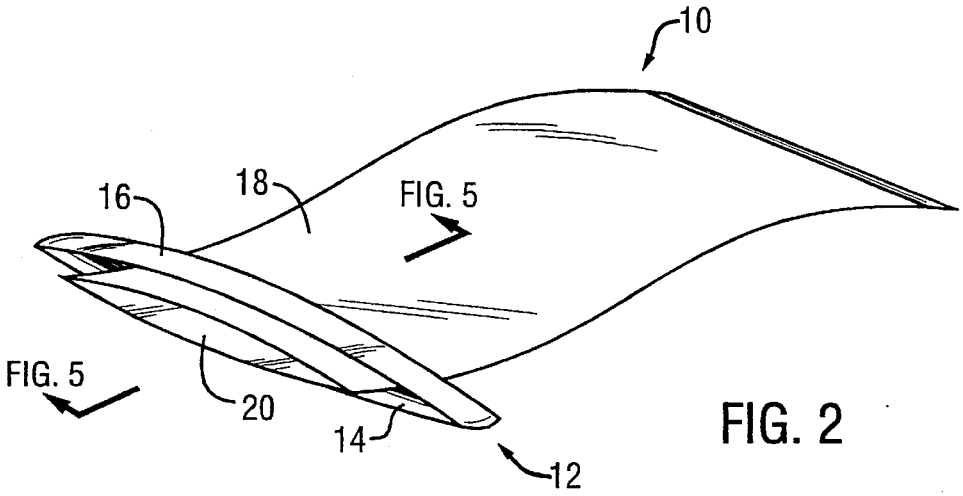
FIG. 2 is a perspective view of the reclosable bag arrangement in FIG. 1, showing the zipper clip slipped over the bag just prior to interlocking male and female closure profiles of the zipper clip.
Figure 3:
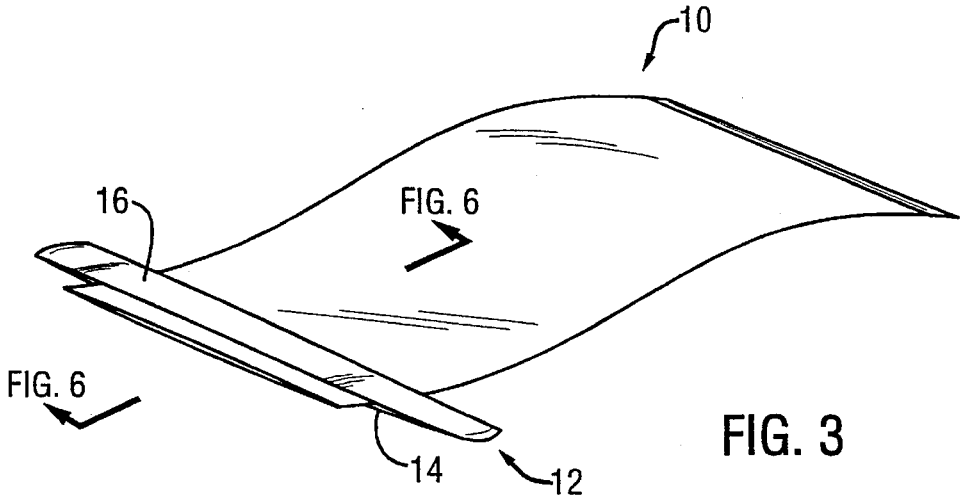
FIG. 3 is a perspective view of the reclosable bag arrangement in FIG. 1, showing the zipper clip slipped over the bag after interlocking the male and female closure profiles of the zipper clip.

Turning now to the drawings, FIGS. 1–3 are perspective views depicting the sequence of closing a bag 10 using a zipper clip 12. In particular, FIG. 1 illustrates the bag 10 prior to telescoping the zipper clip 12 about the exterior of the bag 10. FIG. 2 illustrates the zipper clip 12 telescoped about the exterior of the bag 10 prior to interlocking opposing male and female closure profiles 14, 16 of the zipper clip 12. FIG. 3 illustrates the zipper clip 12 telescoped about the exterior of the bag 10 with the closure profiles 14, 16 of the zipper clip 12 interlocked to one another. The zipper clip 12 in FIG. 3 is preferably oriented substantially parallel to the bag opening.

Opposing ends of the male closure profile 14 are preferably attached to respective opposing ends of the female closure profile 16 by means of heat fusion to facilitate alignment of the closure profiles 14, 16 while interlocking them. The male closure profile 14 is substantially the same length as the female closure profile 16. This length is sufficient to accommodate the bag 10 within the zipper clip 12 between the attached ends of the closure profiles 14, 16 without crinkling the bag 10. The sequence of closing the bag 10 with the zipper clip 12 is described in detail below in connection with FIGS. 4–6, which are section views of respective FIGS. 1–3.

Figure 4:
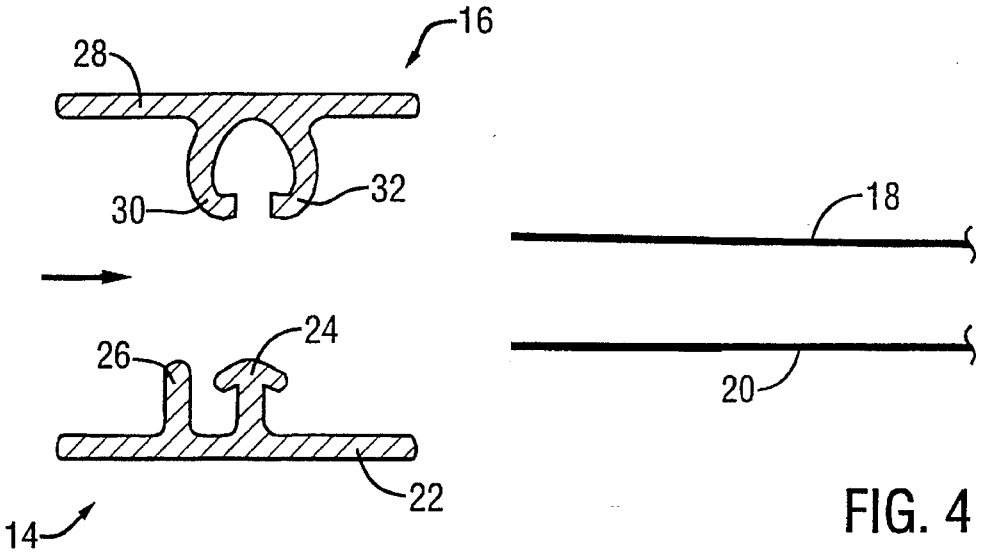
FIG. 4 is a section taken generally along line 4—4 in FIG. 1.
Figure 5:
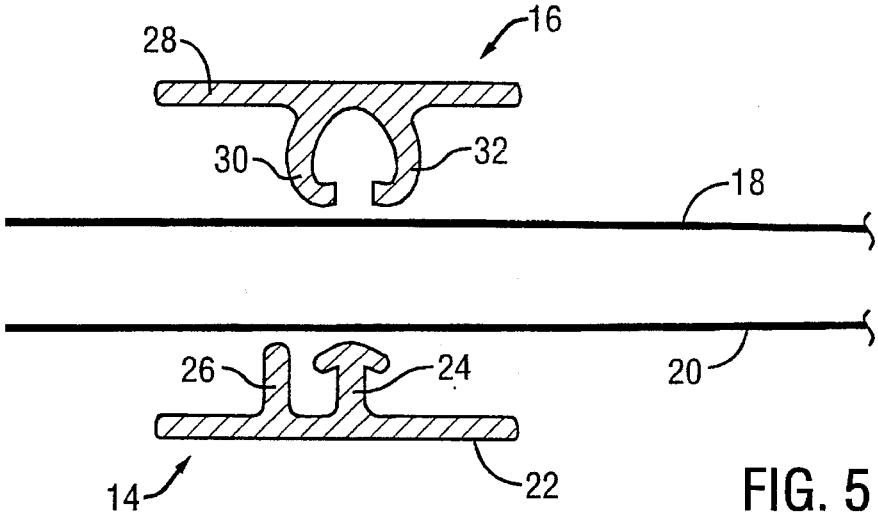
FIG. 5 is a section taken generally along line 5—5 in FIG. 2.
Figure 6:
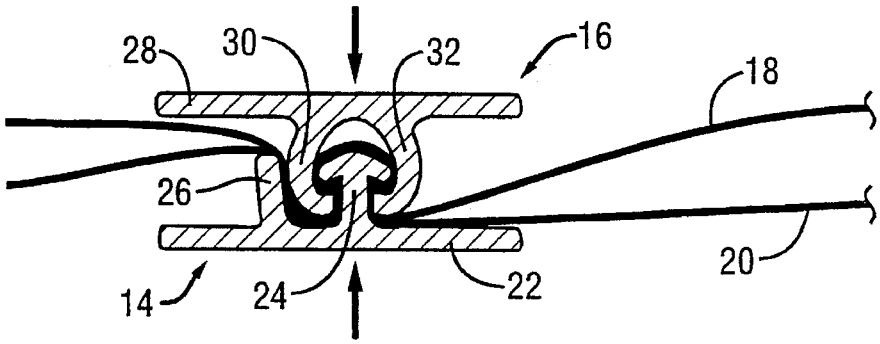
FIG. 6 is a section taken generally along line 6—6 in FIG. 3.

Referring to FIGS. 4–6, the bag 10 includes opposing front and back films 18, 20 which are sealed to each other at their side and bottom edges. The top edges of the respective front and back films 18, 20 are separated from each other to provide the bag 10 with an open mouth end permitting access to the interior of the bag 10. The front and back films 18, 20 are preferably composed of a thin polymeric material such as low density polyethylene ranging in thickness from about 0.50 mils to about 10 mils. The use of such thin front and back films 18, 20 facilitates interlocking of the male and female closure profiles 14, 16 with the front and back films 18, 20 interposed therebetween.

The male closure profile 14 preferably includes a base strip 22, at least one flexible locking member 24, and a post 26. The locking member 24 and the post 26 are integrally formed with and extend inwardly from the base strip 22. The female closure profile 16 preferably includes a base strip 28 and a pair of flexible locking members 30, 32 with hooks at the ends thereof. The locking members 30, 32 are integrally formed with and extend inwardly from the base strip 28, and the locking members 30, 32 form a groove therebetween for receiving the locking member 24. To maintain the locking member 24 in the groove after mating the male and female closure profiles 14, 16, the locking member 24 of the male closure profile 14 is provided with an expanded head adapted to releasably engage the hooks of the locking members 30, 32.

To interlock the male and female closure profiles 14, 16 with the front and back films 18, 20 interposed therebetween, the front and back films 18, 20 of the bag 10 are first inserted between the male and female closure profiles 14, 16 (FIG. 5). The zipper clip 12 is thus disposed outside the bag 10 with the male closure profile 14 adjacent to an outer surface of the back film 20 and the female closure profile adjacent to an outer surface of the front film 18. As previously stated, the male and female closure profiles 14, 16 are preferably positioned substantially parallel to the open mouth end of the bag 10. Next, with the front and back films 18, 20 situated between the male and female closure profiles 14, 16, the male and female closure profiles are engaged to one another (FIG. 6). In particular, the pair of locking members 30, 32 interlock with the locking member 24 in a snapping action caused by bringing the hooks of the pair of locking members 30, 32 past the expanded head of the locking member 24. The post 26 facilitates alignment of the pair of locking members 30, 32 with the locking member 24 during reclosure. The post 26 is laterally spaced from the locking member 24 by a sufficient lateral distance to permit receipt of the locking member 30 between the post 26 and the locking member 24.

As best shown in FIG. 6, the male and female closure profiles 14, 16 are designed to create a generally "S-shaped" gap or passageway therebetween when they are mated with each other. This "S-shaped gap" extending between (1) the locking member 24 and post 26 and (2) the locking members 30, 32 is sufficiently large to accommodate the front and back films 18, 20 when the male closure profile 14 is engaged with the female closure profile 16. Furthermore, the "S-shaped gap" may be designed sufficiently small to prevent fluid from leaking through the interlocked male and female closure profiles 14, 16 so as to make the bag 10 leak-proof.

It is important to note that the zipper clip 12 in FIG. 6 has no connection to the bag 10 aside from capturing the front and back films 18, 20 of the bag 10 between the male and female closure profiles 14, 16. The zipper clip 12 is not adhered by means such as heat fusion to the bag 10. Therefore, it is not necessary for the material forming the zipper clip 12 to be heat-sealable to the material forming the bag 10. This, in turn, increases the number of combinations of materials which may be utilized with each other.

To reopen the bag and gain access to the contents thereof after interlocking the male and female closure profiles 14, 16, the interlocked closure profiles 14, 16 are disengaged from each other by grabbing onto the front and back films 18, 20 near the top edges thereof and pulling them apart. With the closure profiles 14, 16 disengaged from each other, the zipper clip 12 may be temporarily slipped off the bag 10 until it is once again time to reclose the bag 10. If, however, it is no longer desired to use the zipper clip 12 with the bag 10 because, for example, the contents of the bag 10 have been consumed and the bag 10 is discarded, the zipper clip 12 may be saved for reuse with another bag. This new bag must, of course, be sufficiently narrow along its mouth end to fit between the opposing ends of the zipper clip 12, and the front and back films of the new bag must be sufficiently thin to permit interlocking of the male and female closure profiles 14, 16 with the bag films interposed therebetween.

The zipper clip 12 is preferably composed of a mixture of two components. First, the zipper clip material includes a low density polyethylene. Preferably, this low density polyethylene has a melt index of 2 and a density of 0.924. Second, the zipper clip material includes an ethylene vinyl acetate (EVA) copolymer. Preferably, this EVA copolymer has a melt index of 3.5 and a density of 0.930. The preferred weight percentages are about 90% low density polyethylene and about 10% EVA copolymer.

The zipper clip 12 is manufactured from the foregoing zipper clip material using conventional extrusion techniques. More specifically, the zipper clip material is extruded through a die to form a continuous male closure profile and a continuous female closure profile. The closure profiles exit the die separated from one another. After the continuous closure profiles have sufficiently cooled outside the die, the closure profiles are interlocked with each other to create a continuous zipper.

Zipper clips may be formed from this continuous zipper using a couple different techniques. In one technique, the continuous zipper proceeds to a heated cutter which divides the zipper into individual segments. While dividing the zipper into individual segments, the heated cutter simultaneously fuses the male and female closure profiles together at the location of the cutter. As a result, the cutter fuses opposing ends of the male closure profile of a particular segment to respective opposing ends of the female closure profile of that segment, thereby forming the zipper clip 12 from the segment.

In another technique, the continuous zipper is conveyed to a heat seal bar prior to proceeding to a cutter. The heat seal bar applies concentrated heat to the continuous zipper at predetermined distance intervals corresponding to the desired length of the zipper clips. The applied heat fuses the male and female closure profiles together at these distance intervals. After applying heat to the continuous zipper at the predetermined distance intervals, the continuous zipper proceeds to a cutter which successively cuts the continuous zipper approximately midway between each fused portion to form the zipper clips. Since the male and female closure profiles are intermittently fused together prior to reaching the cutter, the cutter need not be heated.

While the present invention has been described with reference to one or more particular embodiments, those skilled in the art will recognize that many changes may be made thereto without departing from the spirit and scope of the present invention.

For example, the closure profiles 14, 16 may be designed so that the "S-shaped" gap (FIG. 6) is sufficiently large to accommodate films slightly thicker than 10 mils or even to accommodate non-polymeric materials such as tin foil, aluminum foil, wax paper, or laminations such as paper/poly/foil/poly.

Furthermore, the zipper clip 12 may be designed with other types of interlocking closure profiles well known in the art. The male closure profile 14, for instance, may include additional locking members, and the female closure profile 16 may include additional locking members adapted to engage with these additional locking members on the male closure profile 14.

Each of these embodiments and obvious variations thereof is contemplated as falling within the spirit and scope of the invention, which is set forth in the following claims.

What is claimed is:

1. A reclosable bag arrangement, comprising:

a bag having first and second opposing films; and an external zipper clip including first and second opposing closure profiles adapted to releasably engage each other, each of the first and second closure profiles having opposing ends, the opposing ends of the first closure profile being permanently attached to the respective opposing ends of the second closure profile to form an opening between the first and second opposing closure profiles, the first and second opposing films extending through the opening in the zipper clip between the first and second closure profiles, the zipper clip closing the bag in response to interlocking the first and second closure profiles by applying pressure to said first and second closure profiles with the first and second films interposed therebetween, the zipper clip not being permanently attached to the bag such that the zipper clip is separable from the bag in response to disengaging the first and second profiles.

2. The reclosable bag arrangement of claim 1, wherein the first closure profile includes a first base strip and a first locking member extending inwardly toward the second closure profile from the first base strip, and wherein the second closure profile includes a second base strip and a second locking member extending inwardly toward the first closure profile from the second base strip, the second locking member being releasably engageable with the first locking member.

3. The reclosable bag arrangement of claim 2, wherein the second closure profile includes a third locking member spaced from the second locking member and extending inwardly toward the first closure profile from the second base strip, the first locking member being releasably engageable between the second and third locking members.

4. The reclosable bag arrangement of claim 1, wherein the first and second closure profiles form a gap therebetween in response to interlocking the first and second closure profiles, the gap being sufficiently large to accommodate the first and second films between the interlocked closure profiles.

5. The reclosable bag arrangement of claim 4, wherein the gap is sufficiently small to prevent fluid from passing through the interlocking closure profiles.

6. The reclosable bag arrangement of claim 1, wherein the first and second films are composed of a polymeric material.

7. The reclosable bag arrangement of claim 6, wherein each of the first and second films ranges in thickness from about 0.25 mils to about 10 mils.

8. The reclosable bag arrangement of claim 1, wherein the zipper clip is substantially parallel to a mouth end of the bag.

9. A reclosable bag arrangement, comprising:

a bag having first and second opposing films; and an elongated zipper clip removably disposed about an exterior of the bag, the zipper clip including opposing male and female closure profiles adapted to releasably engage each other, opposing ends of the male closure profile being permanently attached to respective opposing ends of the female closure profile to form an opening between the male and femme closure profiles, the first and second opposing films extending through the opening in the zipper clip between the male and female closure profiles, the zipper clip closing the bag in response to interlocking the male and female closure profiles by applying pressure to said first and second closure profiles with the first and second films interposed therebetween, the zipper clip being completely separable from the bag in response to disengaging the male and female closure profiles.

10. The reclosable bag arrangement of claim 9, wherein each of the male and female closure profiles has opposing ends, the opposing ends of the male closure profile being attached to the respective opposing ends of the female closure profile.

11. The reclosable bag arrangement of claim 10, wherein a distance between the opposing ends of the male closure profile is approximately the same as a distance between the opposing ends of the female closure profile.

12. The reclosable bag arrangement of claim 11, wherein the distance between the opposing ends of the male closure profile is greater than a width of a mouth end of the bag.

* * * * *